US007931361B2

(12) United States Patent
Nishizaki

(10) Patent No.: US 7,931,361 B2
(45) Date of Patent: Apr. 26, 2011

(54) INK-JET HEAD

(75) Inventor: Masahiro Nishizaki, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 776 days.

(21) Appl. No.: 11/965,824

(22) Filed: Dec. 28, 2007

(65) Prior Publication Data

US 2008/0158323 A1 Jul. 3, 2008

(30) Foreign Application Priority Data

Dec. 28, 2006 (JP) ..... 2006-354884

(51) Int. Cl.
*B41J 2/17* (2006.01)
*B41J 2/175* (2006.01)

(52) U.S. Cl. ..... 347/94

(58) Field of Classification Search ..... 347/65, 347/66, 93, 94
See application file for complete search history.

(56) References Cited

U.S. PATENT DOCUMENTS 4,341,538 A * 7/1982 Vadnay et al. ..... 96/6
5,489,930 A * 2/1996 Anderson ..... 347/71
6,932,462 B2 * 8/2005 Watanabe ..... 347/65
7,229,159 B2 * 6/2007 Chikamoto et al. ..... 347/65

FOREIGN PATENT DOCUMENTS

JP H09-141890 A 6/1997
JP 2002-052730 A 2/2002

OTHER PUBLICATIONS

Japan Patent Office, Notice of Reasons for Rejection mailed Nov. 25, 2008, in priority Patent Application No. 2006-354884.

* cited by examiner

*Primary Examiner* — Anh T. N. Vo
(74) *Attorney, Agent, or Firm* — Baker Botts L.L.P.

(57) ABSTRACT

An ink-jet head according to the present invention includes a passage component, a filter, and a sealing member. The passage component defines an ink passage which includes a middle hole having an opening. The filter partitions the middle hole of the passage component into a first space and a second space. The sealing member seals the opening. The sealing member has a first region which is opposed to the filter with respect to the vertical direction. The filter is mounted to the passage component in such a manner that ink passing through the filter flows from the first space upward into the second space. A surface of the first region of the sealing member facing the ink passage has a portion which is inclined relative to a horizon.

9 Claims, 12 Drawing Sheets

INK-JET HEAD

CROSS REFERENCE TO RELATED APPLICATION

The present application claims priority from Japanese Patent Application No. 2006-354884, which was filed on Dec. 28, 2006, the disclosure of which is herein incorporated by reference in its entirety.

BACKGROUND OF THE INVENTION

1. Field of the Invention

The present invention relates to an ink-jet head which ejects ink.

2. Description of Related Art

Japanese Unexamined Patent Publication No. 9-141890 discloses an ink-jet printer which includes a printing head and a filter unit provided integrally with the printing head, in which ink in an ink cartridge is supplied through the filter unit to the printing head. In the ink-jet printer, the filter unit is provided with a passage through which ink flows against a gravity direction which means an upward direction after the ink passes through a horizontally-extending passage. An impurity capturing filter is provided at an inlet portion of the passage. The filter is slightly inclined relative to a horizontal direction so that one end thereof is located upper than an end thereof which is disposed upstream of the one end. In addition, a filter bypass passage is also provided in the filter unit. The filter bypass passage shunts an upstream side and a downstream side of the filter without interposition of the filter. Since the filter is inclined, air bubbles staying in the filter are guided to the filter bypass passage due to buoyancy. Thus, air bubbles staying in the filter can be discharged.

SUMMARY OF THE INVENTION

According to technique disclosed in Japanese Unexamined Patent Publication No. 9-141890, a filter is disposed at an inlet of the passage through which ink flows upward. Therefore, when inkflow stops, impurities contained in the ink which have been captured by the filter are separated from the filter and drop down due to their own weight. The impurities having dropped down from the filter are kept at a part of a horizontal passage which is opposed to the filter. Accordingly, when ink starts flowing, the impurities move toward the filter together with the ink and are captured by the filter again. As the printer is used for a longer term, an amount of impurities which are repeatedly captured by the filter increases. Consequently, the filter is clogged, and undersupply of ink occurs.

An object of the present invention is to provide an ink-jet head having a filter which hardly causes clogging by impurities.

According to first aspect of the present invention, there is provided an ink-jet head comprising a passage component, a filter, and a sealing member. The passage component defines an ink passage including an ink inflow hole through which ink flows in, an ink outflow hole through which ink having flown in through the ink inflow hole flows out, and a middle hole having an opening which opens downward and formed between the ink inflow hole and the ink outflow hole. The ink passage extends from the ink inflow hole through the middle hole to the ink outflow hole. The filter is formed with a plurality of through holes for filtering ink, and partitions the middle hole into a first space which communicates with the ink inflow hole and includes the opening and a second space which communicates with the ink outflow hole. The sealing member seals the opening, and has a first region which is opposed to the filter with respect to a vertical direction. The filter is mounted to the passage component in such a manner that ink passing through the filter flows from the first space upward into the second space. A surface of the first region of the sealing member facing the ink passage has a portion which is inclined relative to a horizon.

In this aspect, ink having flown through the ink inflow hole into the first space passes upward through the filter and flows into the second space. An impurity in the ink is captured by the filter and, when inkflow stops, drops down on the surface of the sealing member. Since the surface of the sealing member facing the ink passage has the portion inclined relative to the horizon, an impurity having dropped on the inclined portion moves downward, that is, toward an upstream with respect Do the inkflow, along the surface. In this manner, a plurality of impurities are collected. The plurality of impurities thus collected make an impurity block. The impurity block has greater mass than that of one small impurity. Therefore, even though ink in the ink passage starts flowing again toward the filter, the impurity block hardly moves toward the filter. Even if the impurity block is carried together with the ink toward the filter, the impurity block which is sufficiently larger than a mesh of the filter is hardly captured by the filter. In addition, since the impurity block once formed is hard to disassemble, it hardly occurs that an impurity derived from the impurity block is captured by the filter. Therefore, the filter is not easily clogged, and undersupply of ink which may be caused by impurities is suppressed.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
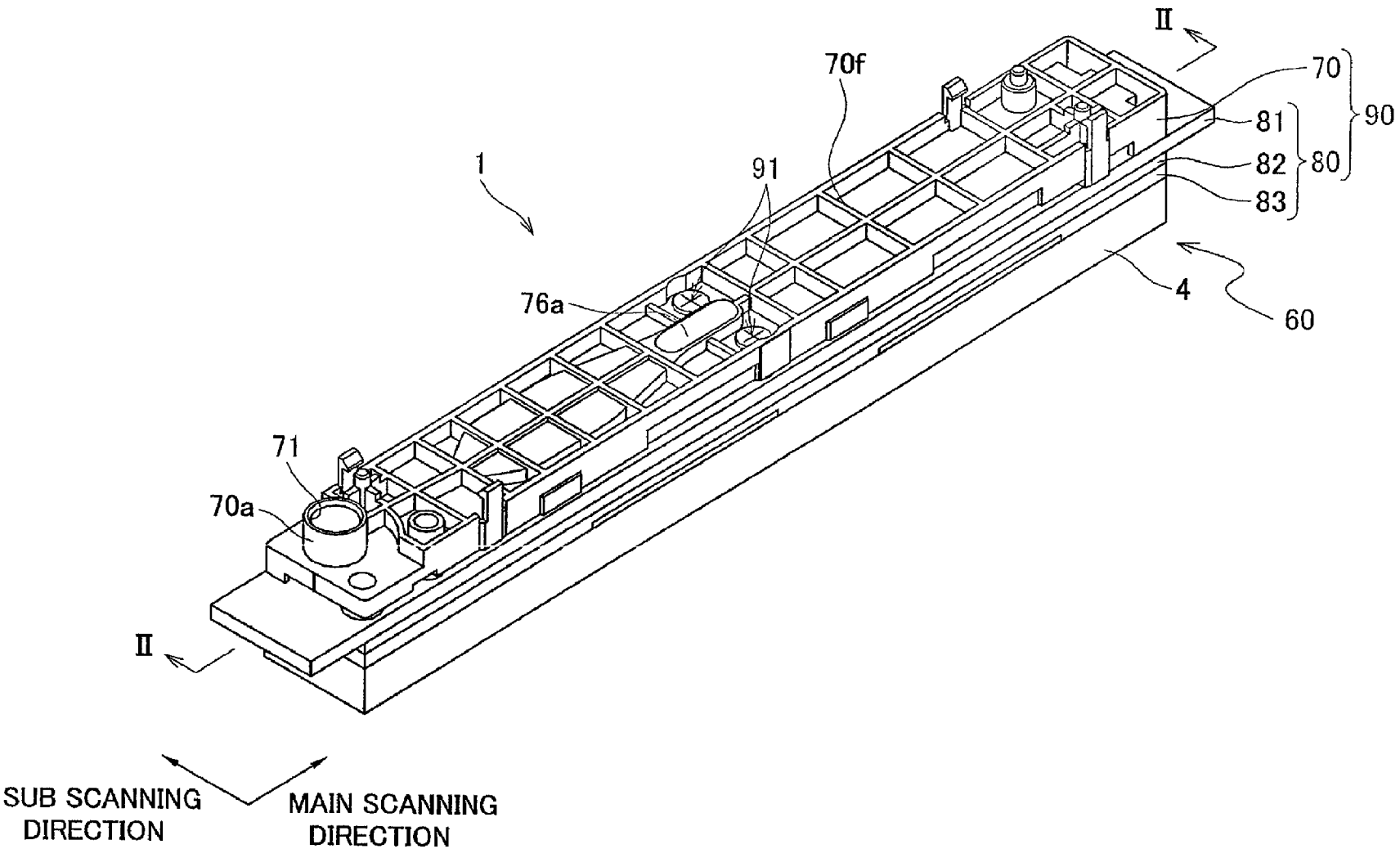
FIG. 1 is a perspective view of an ink-jet head according to an embodiment of the present invention.

An ink-jet head 1 according to an embodiment of the present invention, which is shown in FIG. 1, has a shape elongated in a main scanning direction and includes, from a lower position, a head main body 60 and a reservoir unit 90 which is put on the head main body 60. The head main body 60 includes a passage unit 4 and four actuator units 21 which are adhered to an upper face of the passage unit 4 (see FIG. 7). The reservoir unit 90 includes, from an upper position, a filter support 70 made of a resin and an ink distributor 80 made of a metal. The filter support 70 is a passage component.

The filter support 70 is integrally formed by a resin. A pipe-shaped protrusion 70*a* protrudes upward from an upper face 70*f* of the filter support 70. An ink inflow hole 71 extending in a vertical direction is formed inside the pipe-shaped protrusion 70*a*. A flexible tube is attached to the pipe-shaped protrusion 70*a*. Ink in an ink tank which is an ink supply source is, via the tube, introduced through the ink inflow hole 71 into the filter support 70.

Figure 2:
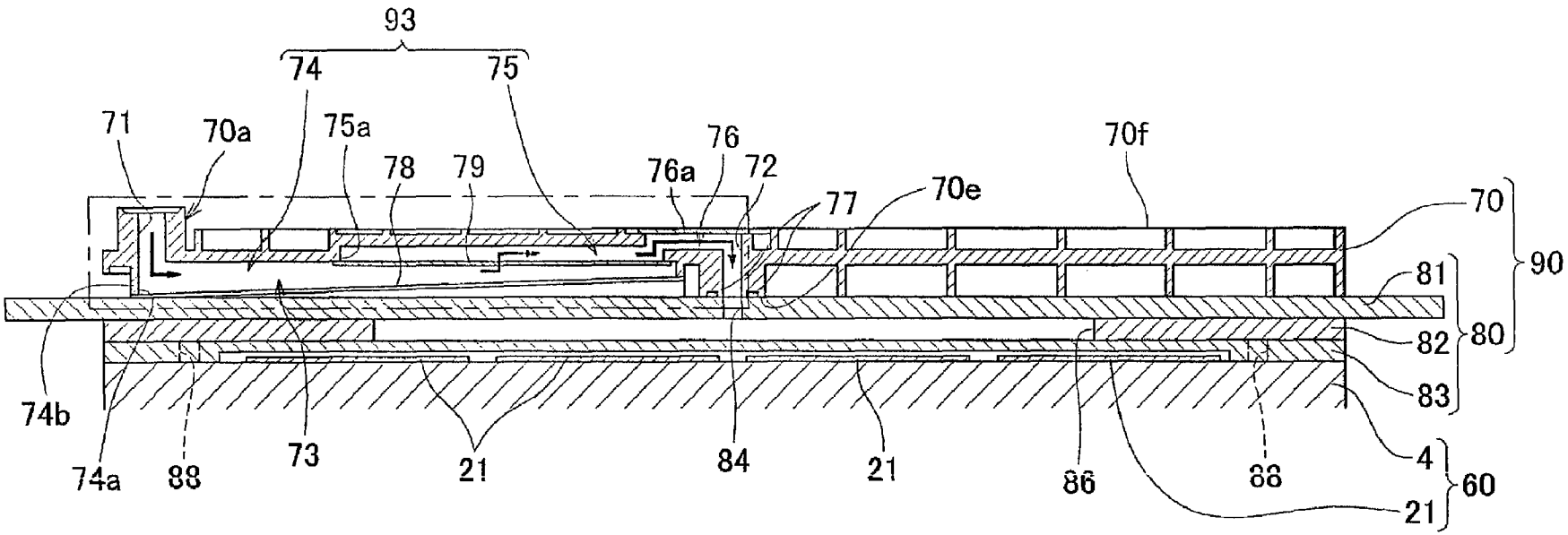
FIG. 2 is a sectional view as taken along line II-II in FIG. 1.

As shown in FIG. 2, an ink passage 73 including the ink inflow hole 71 and an ink outflow hole 72 is formed within the filter support 70. The ink inflow hole 71 is formed with an ink inflow opening and extends in the vertical direction. The ink outflow hole 72 is formed with an ink outflow opening and extends in the vertical direction. The ink passage 73 has a middle hole 93 between the ink inflow hole 71 and the ink outflow hole 72. The middle hole 93 has an opening 74*a* which opens downward.

A filter 79 is mounted to the filter support 70. A plurality of fine through holes 79*a* for filtering ink are formed in the filter 79. The filter 79 partitions the middle hole 93 into a first space 74 and a second space 75. The first space 74 communicates with the ink inflow hole 71, and has the opening 74*a*. The second space 75 communicates with the ink outflow hole 72. A downstream region 76 of the second space 75 which is not opposed to the filter 79 extends in a horizontal direction at a position slightly higher than an upstream region of the second space 75 which is opposed to the filter 79. The ink outflow hole 72 extends vertically downward from a right end of the downstream region 76, and opens in a lower face 70*e* of the filter support 70. Here, for convenience of explanation, FIG. 2 illustrates even a portion which actually does not appear in a section simply along line II-II.

Figure 3A:
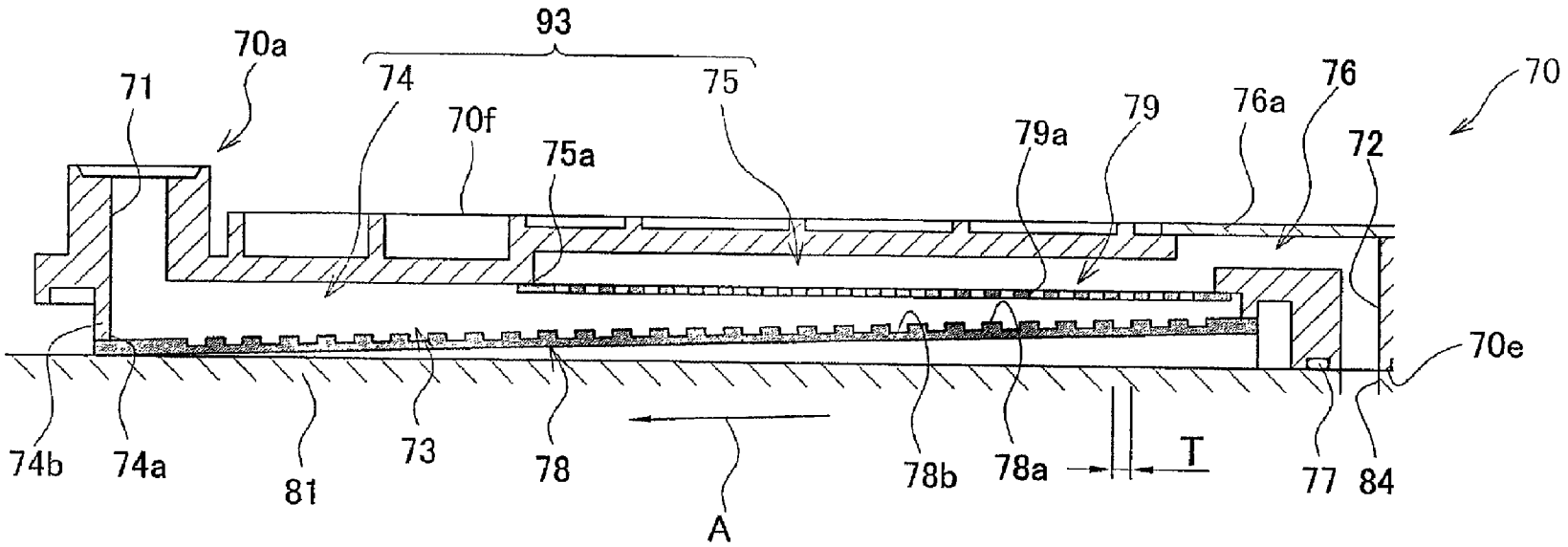
FIG. 3A is an enlarged view of a region which is enclosed by an alternate long and short dash line in FIG. 2.

As shown in FIG. 3A, the first space 74 has a flat shape extending in the horizontal direction. The opening 74*a* is sealed with a damper film 78 which is a sealing member. The damper film 78 has an opposing region which is opposed to the filter 79 with respect to the vertical direction, and a non-opposing region which is located upstream of the opposing region along inkflow and not opposed to the filter 79. In a plan view, the opening 74*a* has substantially the same shape as that of the damper film 78 (see FIG. 4B). Thus, the damper film 78 cooperates with the filter support 70 to define the ink passage 73. In a plan view, the opening 74*a* is tapered toward both directions with respect to inkflow within the first space 74.

An outer side wall 74*b* which surrounds the opening 74*a* of the first space 74 extends to a lowest portion just under the ink inflow hole 71. At a portion closer to the ink outflow hole 72, the outer side wall 74*b* extends downward by a shorter distance. Accordingly, the damper film 78 which is fixed to a distal end of the outer side wall 74*b* is inclined at a constant angle relative to a horizon so that its portion closer to the ink inflow hole 71 is located lower. As a result, the non-opposing region of the damper film 78 is located lower than the opposing region thereof.

The second space 75 has an opening 75*a* which opens downward. The opening 75*a* corresponds to a downstream of a substantially center of the first space 74, and is opposed to a portion of the damper film 78 existing from a substantially center to a right end thereof. Like the opening 74*a*, the opening 75*a* is tapered toward both directions with respect to a flowing direction. A shape of the filter 79 is substantially the same as a planar shape of the opening 75*a* and, in a plan view, slightly larger than the opening 75*a*. The filter 79 is fixed in the first space 74 so as to cover the opening 75*a*. That is, the filter 79 is mounted to the filter support 70 so as to be opposed to the opening 74*a* and the damper film 78.

With this structure, ink from the ink inflow hole 71 flows through the first space 74 horizontally from left to right and, from a region opposed to the filter 79, flows upward along the filter 79, as shown in FIG. 2. The ink flows into the second space 75 via the through holes 79*a* of the filter 79. At this time, impurities which exist in ink in the first space 74 are captured by the filter 79, and ink having impurities removed therefrom flows from the first space 74 to the second space 75. After passing through the downstream region 76 of the second space 75, the ink flows downward through the ink outflow hole 72 and flows out from the ink outflow hole 72 into the ink distributor 80.

The damper film 78 is formed of a flexible resin film. There is a gap between the damper film 78 and an upper face of the ink distributor 80, that is, between the damper film 78 and an upper face of a later-described reservoir plate 81, to allow the damper film 78 to displace in accordance with ink vibration. With this structure, the damper film 78 displaces in a substantially vertical direction in accordance with ink vibration, and thus the damper film 78 can absorb and damp ink vibration.

Figure 3B:
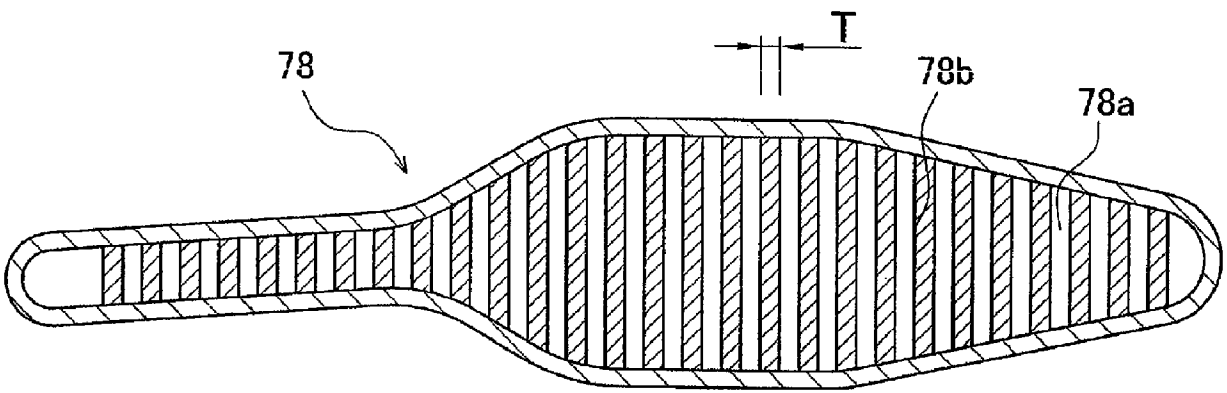
FIG. 3B is a schematic plan view of a damper film illustrated in FIG. 3A.

On a surface 78*a* of the damper film 78 facing the ink passage 73, a plurality of grooves 78*b* which open toward the ink passage 73 are formed by laser-beam machining. The grooves 78*b* extend in a direction which is perpendicular to an ink flowing direction in the first space 74 or in a direction perpendicular to an inclination direction A of the damper film 78 (see FIG. 3A). For easy understanding, the grooves 78*b* are hatched in FIG. 3B. In FIG. 3B, a peripheral portion of the damper film 78 which is fixed to the distal end of the outer side wall 74*b* of the first space 74 is also hatched.

In this embodiment, a width T of an opening of the groove 78*b* with respect to the inclination direction A (which means a direction in which a plurality of grooves 78*b* are arranged) is formed exactly to 1.2 times a diameter of the through hole 79*a* which is formed in the filter 79. However, the width T may be within a range from 0.8 to 1.2 times the diameter of the through hole 79*a* which is formed in the filter 79. Setting the width v to within this range enables impurities separated from the filter 79 and having dropped due to their own weight to enter and exit the groove 78*b*. Moreover, since the damper film 78 is inclined and displaces due to ink vibration, force directed from one groove 78*b* to another groove 78*b* formed upstream of the one groove 78*b* can be easily applied to the impurities. In addition, due to a step formed by the groove 78*b*, movement of the impurities in an opposite direction (which means a direction from an upstream to a downstream) can be suppressed.

This is because the impurity which has entered the groove 78*b* is relatively close to a side wall of the groove 78*b* so that due to displacement of the damper film 78 the impurity easily comes into contact with a downstream side wall of the groove 78*b* (which means a right side wall of the groove 78*b* in FIG.

3A). By bringing the impurity into contact with the downstream side wall of the groove 78*b*, large force which makes the impurity fly toward an upper left in FIG. 3A can be applied to the impurity. Here, only by the inclination of the damper film 78, the force which makes the impurity fly toward the upper left in FIG. 3A can be applied to the impurity when the damper film 78 displaces. In this embodiment, however, the force making the impurity fly is enhanced by bringing the downstream side wall of the groove 78*b* into contact with the impurity. In this way, the impurity flies toward the more upstream groove 78*b*.

Like this, due to the grooves 78*b* being formed in the damper film 78, it is easier to move impurities existing on the surface 78*a* of the damper film 78 in the inclination direction, that is, from the downstream to the upstream with respect to the ink flowing direction, from a region of the damper film 78 opposed to the filter 79. In addition, movement of the impurity in the opposite direction is interrupted by the downstream side wall of the groove 78*b*, and therefore hardly occurs. In particular, since the width T is in the range from 0.8 to 1.2 times the diameter of the through hole 79*a*, the impurity can more effectively be moved in the inclination direction. If the width T of the opening is smaller than 0.8 times the diameter of the through hole 79*a*, the width T is too narrow for an impurity having entered a groove 78*b* to exit the groove 78*b*. Therefore, it is difficult for the impurity to move, even though the force directed to more upstream grooves 78*b* is applied to the impurity. If the width T of the opening is larger than 1.2 times the diameter of the through hole 79*a*, the width T is so large that an impurity having entered a groove 78*b* slides down in the inclination direction A within the groove 78*b*, to produce a large gap between the impurity and the downstream side wall of the groove 78*b*. As a result, substantially no contact occurs between the downstream side wall of the groove 78*b* and the impurity. This makes it difficult to apply to the impurity the force directed toward more upstream grooves 78*b*.

As shown in FIG. 3A, an opening which communicates the downstream region 76 to the outside is formed in an upper face 70*f* of the filter support 70. This opening is sealed by a film 76*a*. The film 76*a* has flexibility, and displaces in accordance with ink vibration thereby absorbing and damping the ink vibration.

As shown in FIG. 2, an annular recess which surrounds an outlet of the ink outflow hole 72 is formed in a lower face 70*e* of the filter support 70. An O-ring 77 made of an elastic material is disposed in the recess. The O-ring 77 effectively prevents ink leakage in the lower face 70*e* of the filter support 70.

Figure 4A:
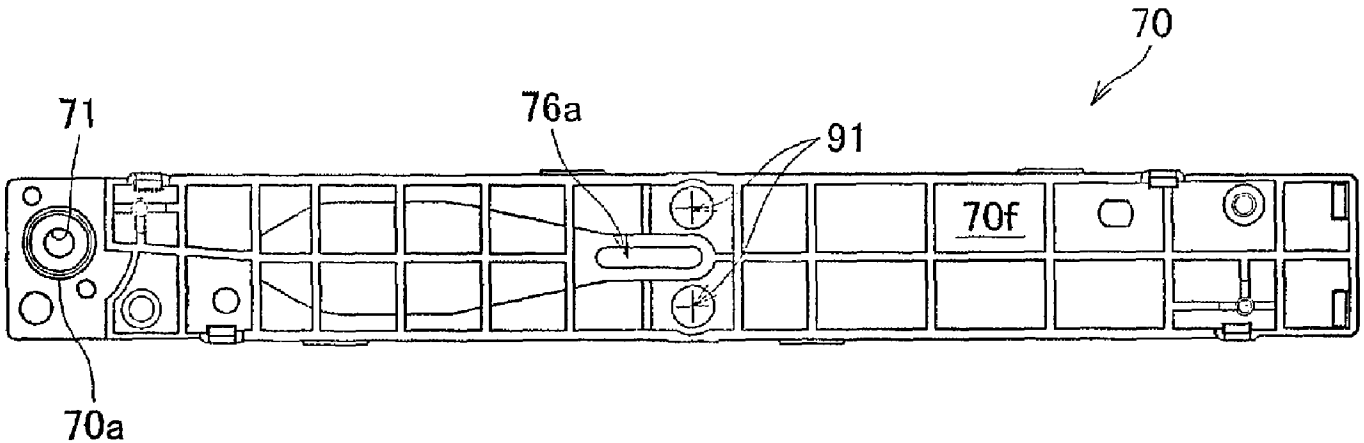
FIG. 4A is a plan view of a filter support of a reservoir unit which is included in the ink-jet head.
Figure 4B:
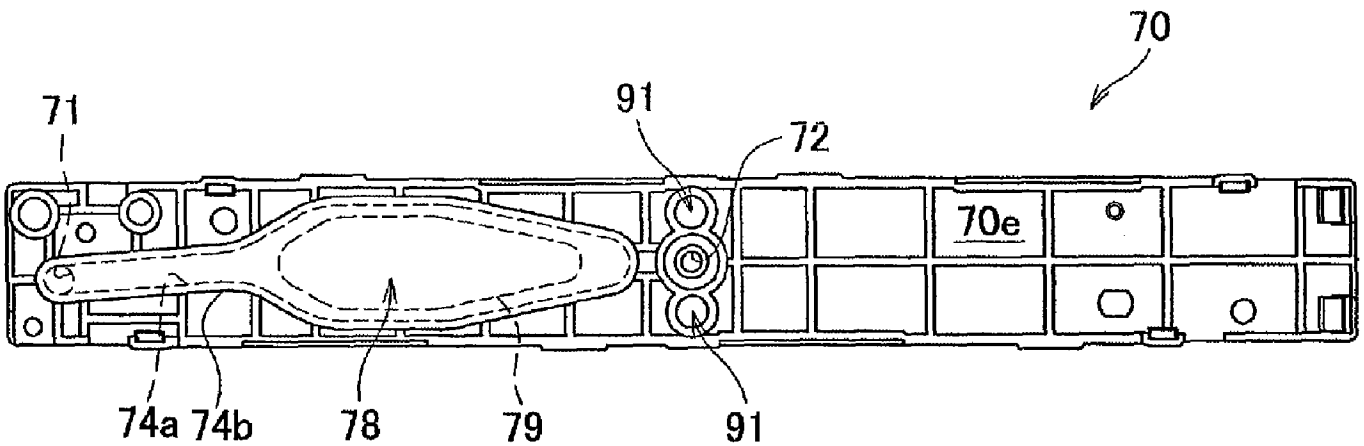
FIG. 4B is a bottom view of the filter support.

Not-shown holes extending through a thickness of the filter support 70 are formed on both sides of the outflow hole 72 of the filter support 70 with respect to the sub scanning direction. As shown in FIGS. 4A and 4B, screws 91 are inserted into the two holes. The filter support 70 and the ink distributor 80 are fixed to each other by the screws 91.

Figure 5A:
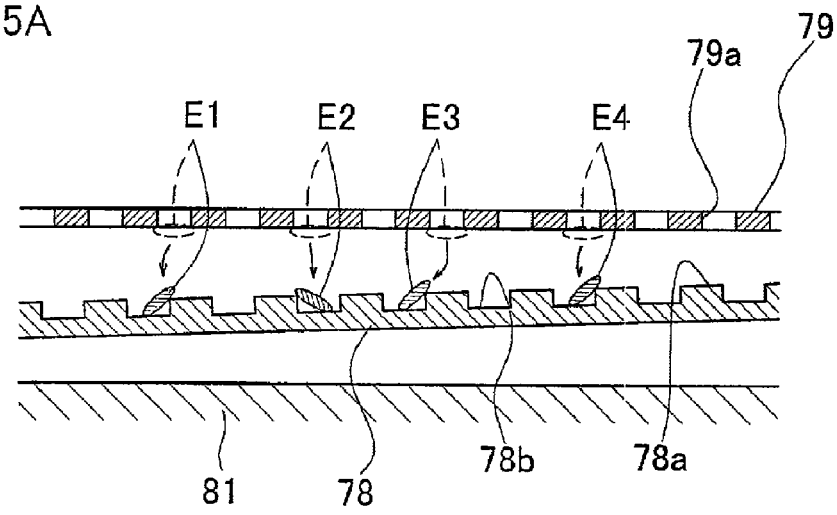
FIGS. 5A, 5B, and 5C show that impurities existing on a surface of the damper film are moving.
Figure 5B:
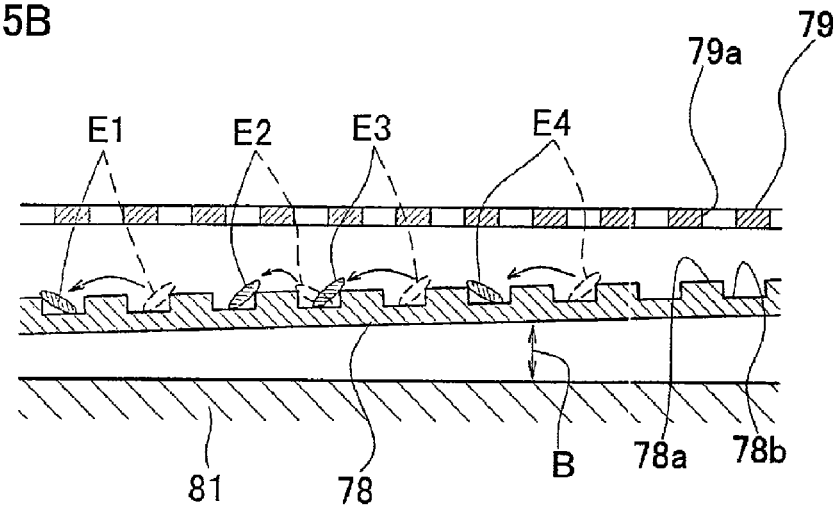
Figure 5C:
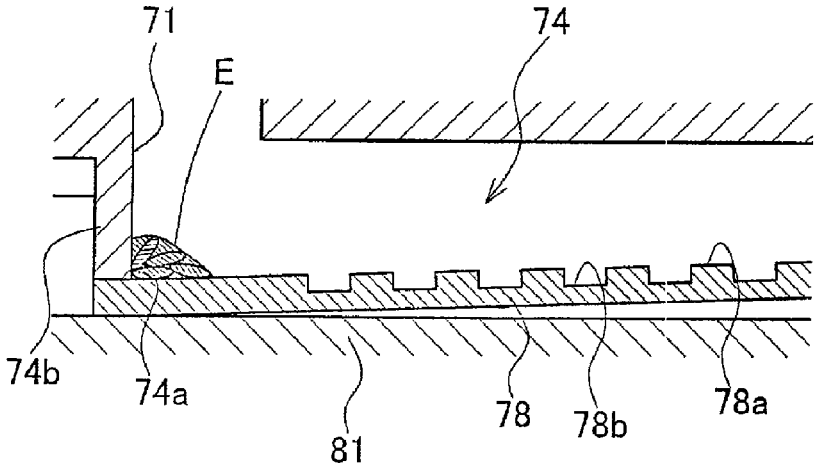

Here, with reference to FIGS. 5A, 5B, and 5C, a description will be given to movement of the impurity on the damper film 78 when the damper film 78 vibrates. Ink flowing through the ink inflow hole 71 into the first space 74 flows within the first space 74 substantially horizontally from left to right, and flows upward from the region opposed to the filter 79. The ink passes through the filter 79 and flows into the second space 75. At this time, in accordance with ink vibration caused by ink introduced from the ink inflow hole 71, the damper film 78 displaces in the substantially vertical direction in a short cycle, to absorb the ink vibration. In a case where ink contains impurities having a diameter larger than the diameter of the through hole 79*a*, inlets of a plurality of through holes 79*a* are closed with a plurality of impurities E1 to E4, as illustrated with broken lines in FIG. 5A. In this way, the impurities E1 to E4 existing in ink which flow from the first space 74 to the second space 75 are captured by the filter 79.

When inkflow stops, the impurities E1 to E4 captured by the filter 79 are, due to their own weight, separated from the filter 79 and drop into the grooves 78*b* and on the surface 78*a* in a region opposed to the filter 79 of the damper film 78.

The damper film 78 is inclined at a constant angle relative to the horizon so that the nonopposing region is located lower than the opposing region. Accordingly, as shown in FIG. 5B, impurities having dropped on the surface 78*a* slide down along the surface 78*a* and moves into the groove 78*b*. At this time, although inkflow is stopping, the damper film 78 displaces, that is, vibrates, in an vertical direction in a short cycle because of various impacts from the outside, as indicated by an arrow B. Since the damper film 78 is inclined, the above-described force making the impurities E1 to E4 fly toward the upper left acts on the impurities E1 to E4 due to displacement of the damper film 78. Consequently, the impurities E1 to E4 existing in the grooves 78*b* and on the surface 78*a* move from their positions in the grooves 78*b* which are illustrated with broken lines in FIG. 5B, toward the upstream. Thus, the impurities E1 to E4 sequentially move into more upstream grooves 78*b*.

To be more specific, after an impurity existing in a certain groove 78*b* flies toward the upper left due to displacement of the damper film 78, the impurity lands on the damper film 78 at a position where another groove 78*b* exists. Accordingly, the impurity advances from the certain groove 78*b* to a more upstream groove 78*b*, and is stopped. Even when an impurity flies and lands on a position where the groove 78*b* does not exactly exists, the damper film 78 is inclined and therefore the impurity moves on the surface 78*a* in the inclination direction A into an upstream groove 78*b*. The impurity flies out of this groove 78*b* toward the upstream and lands on the damper film 78 at a position where a groove 78*b* also exists or at such a position that a groove 78*b* also exists away from the position with respect to the inclination direction A. Therefore, the impurities E1 to E4 sequentially move from the downstream to the upstream. In this way, the impurities E1 to E4 having moved from certain grooves 78*b* to upstream grooves 78*b* are finally collected at a most upstream portion of the damper film 78, as shown in FIG. 5C. Like this, since the plurality of grooves 78*b* are formed in the damper film 78, the impurities E1 to E4 can be surely moved from certain grooves 78*b* to more upstream grooves 78*b*, that is, moved in the inclination direction A.

Most of an impurity which does not reach the most upstream portion of the damper film 78 is located in the groove 78*b*. Accordingly, even though ink starts flowing from the upstream to the downstream, it hardly moves from the groove 78*a*. This is because an extending direction of the groove 78*b* is perpendicular to the ink flowing direction and therefore an upstream side wall of the groove 78*b* (which means a left side wall of the groove 78*b* in FIG. 3A) interrupts movement of the impurity. In addition, the damper film 78 is inclined in such a manner that the first space 74 has a larger cross section at a more upstream part thereof. Accordingly, at a more upstream part in the first space 74, ink flows at a lower velocity and the impurities move less easily.

Like this, the plurality of impurities E1 to E4 are collected at the most upstream portion of the damper film 78, and aggregated into a signal impurity block E. The impurity block E has greater mass than that of each of the small impurities E1 to E4. Therefore, even though ink in the first space 74 starts flowing toward the filter 79, the impurity block E hardly moves. Even if the impurity block E is carried together with the ink toward the filter 79, the impurity block E which is sufficiently larger than a mesh of the filter 79 is hardly captured by the filter 79.

In addition, since the impurity block E once formed is hard to disassemble, it hardly occurs that an impurity derived from the impurity block E is captured by the filter 79. Therefore, the filter 79 is not easily clogged, and undersupply of ink which may be caused by the impurities E1 to E4 is suppressed. For example, if four impurities E1 to E4 independently exist, there is a fear that inlets of four through holes 79*a* are closed. However, in a case where the impurities E1 to E4 form the impurity block E, the impurity block E does not reach any through hole 79*a*. Even if the impurity block E reaches any through hole 79*a*, it is hardly captured by the filter 79. Even if the impurity block E was captured by the filter 79, the impurity block E would close merely one through hole 79*a*. Accordingly, undersupply of ink hardly occurs.

Figure 6:
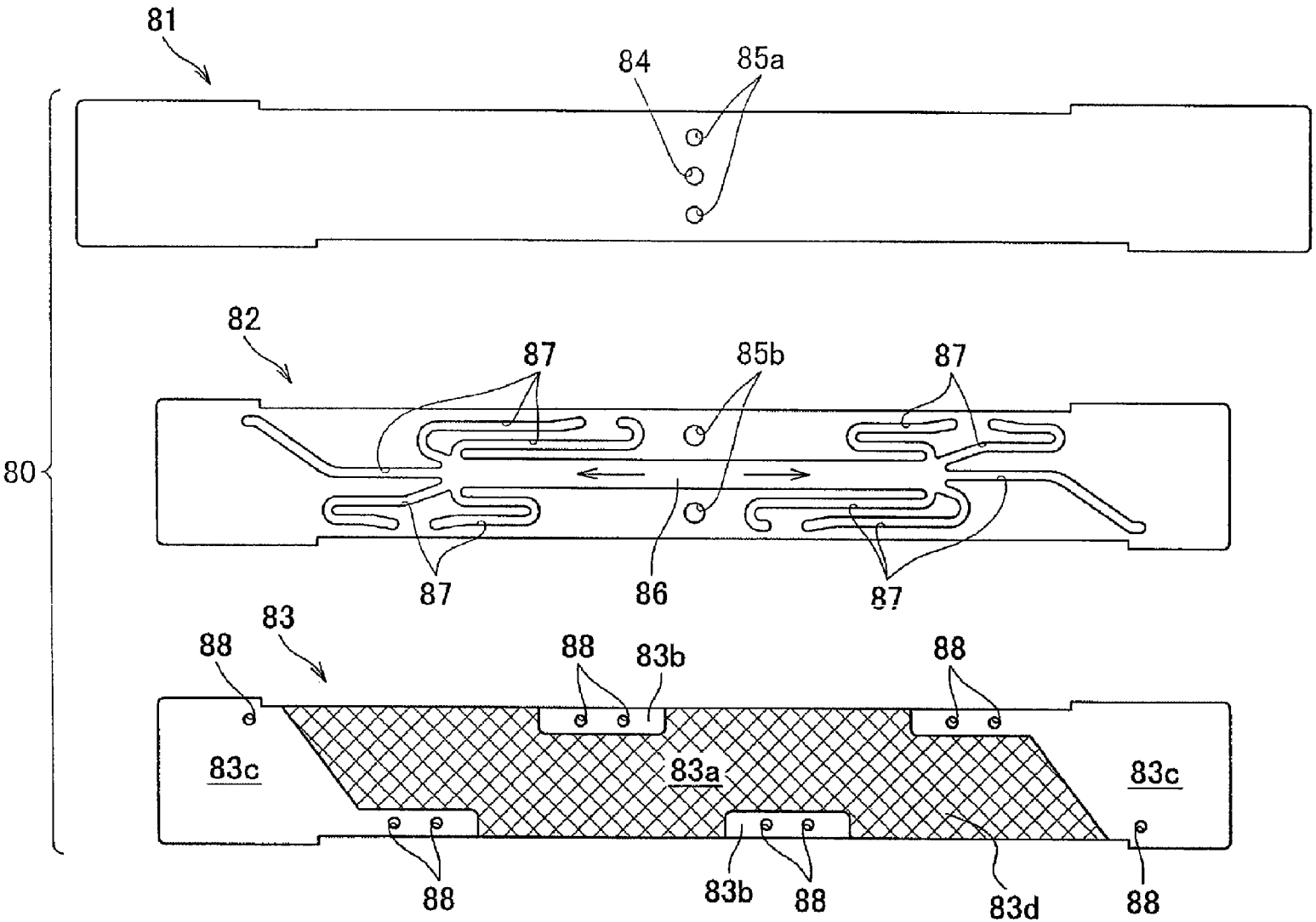
FIG. 6 is a bottom view of respective plates which form an ink distributor of the reservoir unit.

Next, the ink distributor 80 which is included in the reservoir unit 90 will be described. As shown in FIG. 6, the ink distributor 80 has a reservoir base plate 81, a reservoir plate 82, and an under plate 83, all made of a metal. The three metal plates 81, 82, and 83 are put in layers and bonded to one another with an adhesive, thus forming the ink distributor 80. In a plan view, any of the plates 81 to 83 has a substantially rectangular shape elongated in the main scanning direction (see FIG. 1). The plates 81 to 83 have the same width. The reservoir base plate 81 is a slightly longer than the other two plates 82 and 83, and both longitudinal ends thereof protrude as shown in FIG. 1. This is because, in the reservoir base plate 81, the head 1 is fixed to a not-shown holder of a recording apparatus.

An ink passage extending from an inflow hole 84 to communication holes 88 is formed in the ink distributor 80, too. The inflow hole 84 which communicates with the ink outflow hole 72 of the filter support 70 is formed at a center of the reservoir base plate 81. Holes 85*a* are formed symmetrically on both sides of the inflow hole 84 with respect to the sub scanning direction. The two holes 85*a* are disposed so as to correspond to the holes for the screws 91 which are formed through the filter support 70. Both of the inflow hole 84 and the holes 85*a* extends through a thickness of the reservoir base plate 81.

A hole which corresponds to a main ink chamber 86 and branch passages 87 branched from the main ink chamber 86 is formed through a thickness of the reservoir plate 82, so that ink having flown in through the inflow hole 84 is distributed to respective communication holes 88 which are formed in the under plate 83. The main ink chamber 86 extends in a lengthwise direction of the reservoir plate 82, and serves as a reservoir in which ink from the inflow hole 84 is temporarily stored. Ink having flown through the inflow hole 84 into a center of the main ink chamber 86 flows from the center toward the lengthwise direction of the reservoir plate 82 into the respective branch passages 87. Holes 85*b* which extend through the thickness of the reservoir plate 82 are formed in the reservoir plate 82 at positions corresponding to the holes 85*a* of the reservoir base plate 81.

Female screws are threaded on inner faces of the holes 85*b*. The screws 91 are inserted into the through holes formed in the filter support 70 and the holes 85*a*, and threadedly engaged with the holes 85*b*, so that the filter support 70 and the ink distributor 80 are fixed to each other.

On a lower face of the under plate 83, a recess and a protrusion are formed by half-etching. A hatched portion in FIG. 6 is a recess 83*a*. The recess 83*a* is formed into a size and shape which includes a region of the upper face of the passage unit 4 where four actuator units 21 are fixed (see FIG. 7). Two protrusions 83*b* and two protrusions 83*c* are formed on the lower face of the under plate 83 so as to define the recess 83*a* and avoid a region corresponding to the actuator units 21. The two protrusions 83*b* are arranged in a zigzag pattern with respect to a lengthwise direction of the under plate 83. The two protrusions 83*c* are disposed at both lengthwise ends of the under plate 83.

Two communication holes 88 are formed through each protrusion 83*b*. Three communication holes 88 are formed through each protrusion 83*c*. The two neighboring communication holes 88 formed in the protrusion 83*c* and the two neighboring communication holes 88 formed in the protrusion 83*b* are, as one set, arranged in a zigzag pattern with respect to the lengthwise direction of the under plate 83. The total of ten communication holes 88 are arranged substantially point-symmetrically with respect to a center of the under plate 83. Each of the communication holes 88 communicates with an ink passage within the passage unit 4. Ink flows from the main ink chamber 86 into the respective branch passages 87 of the reservoir plate 82, and then flows from distal ends of the respective branch passages 87 into the communication holes 88. Then, the ink is supplied through openings 3*a* to the passage unit 4.

The under plate 83 is fixed to the passage unit 4 in such a manner that the four actuator units 21 are received within the recess 83*a* with the protrusions 83*b* and 83*c* being in contact with the upper face of the passage unit 4. At this time, a space is formed between a bottom face of the recess 83*a* and the upper face of the passage unit 4. The actuator units 21 are bonded to a part of the upper face of the passage unit 4 corresponding to the space (see FIGS. 2 and 7). A narrow gap is ensured between each actuator unit 21 and a bottom face 83*d* of the under plate 83.

Figure 8:
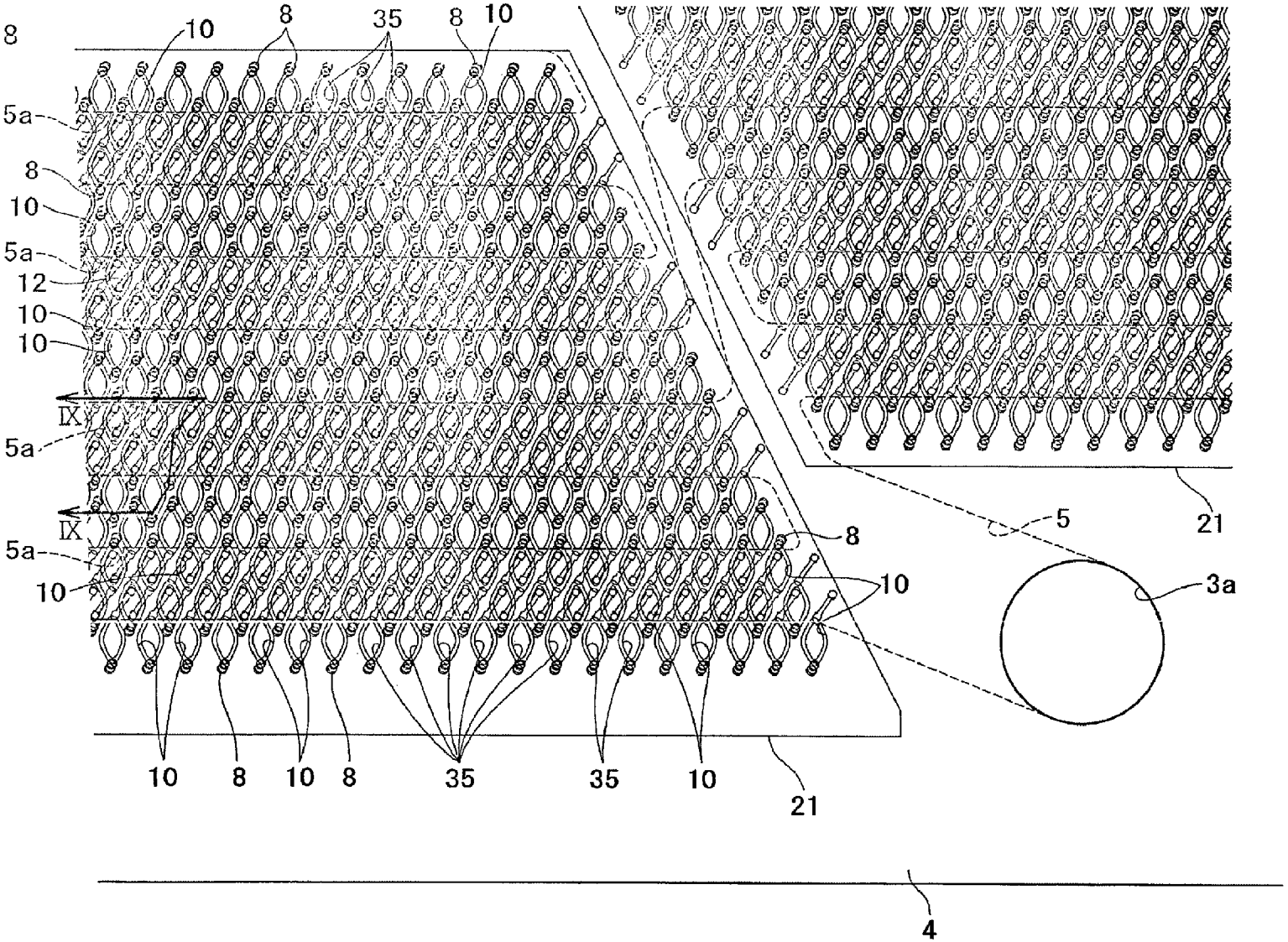
FIG. 8 is an enlarged view of a part which is enclosed by an alternate long and short dash line in FIG. 7.
Figure 9:
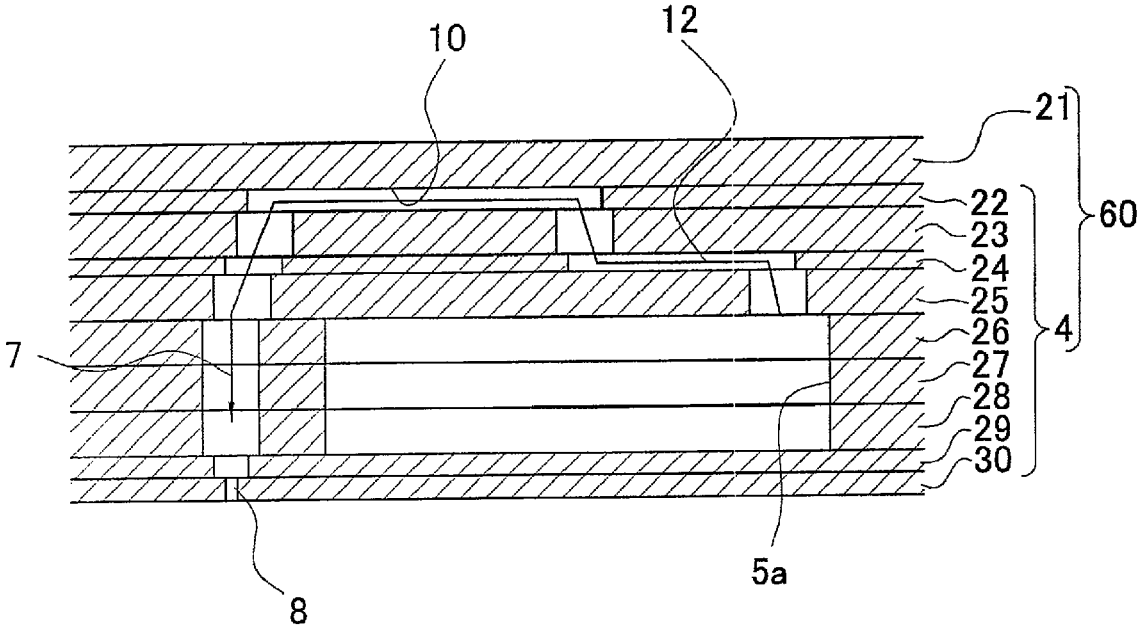
FIG. 9 is a sectional view as taken along line IX-IX in FIG. 8.

Next, the head main body 60 will be described with reference to FIGS. 8 and 9 in addition to FIGS. 1 to 7. FIG. 8 is an enlarged view of a part which is enclosed by an alternate long and short dash line in FIG. 7. For easy understanding, pressure chambers 10, apertures 12, and openings of nozzles 8 are illustrated with solid lines although they are located under the actuator units 21 and therefore should actually be illustrated with broken lines. FIG. 9 is a sectional view as taken along line IX-IX in FIG. 8.

As shown in FIG. 1, the passage unit 4 has a substantially rectangular parallelepiped shape elongated in the main scanning direction. In a plan view, a size and shape of the passage unit 4 is substantially the same as those of the two plates 82 and 83 other than the reservoir base plate 81 of the ink distributor 830.

Figure 7:
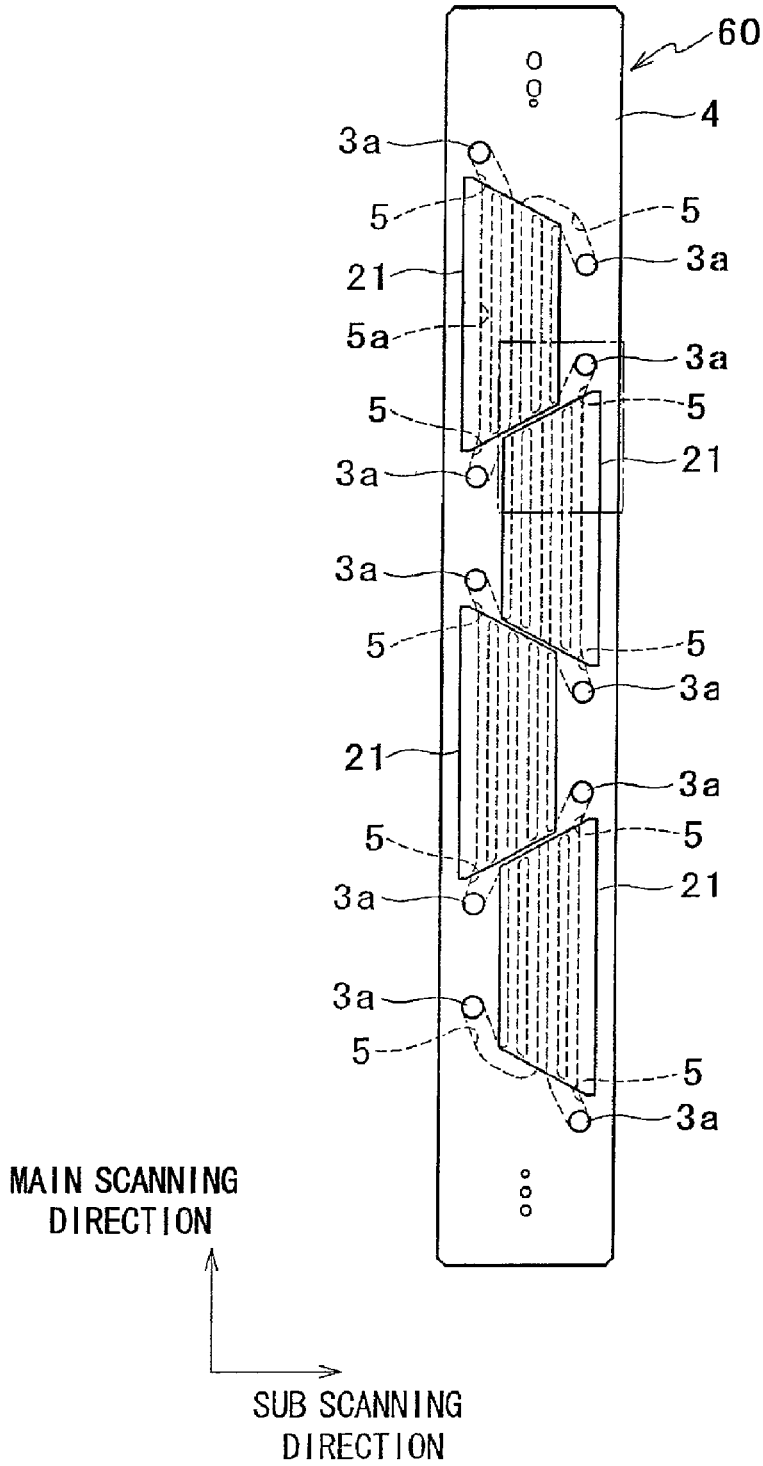
FIG. 7 is a plan view of a head main body which is included in the ink-jet head.

As shown in FIG. 7, a total of ten openings 3*a* are formed on the upper face of the passage unit 4 so as to avoid the actuator units 21. The ten openings 3*a* form two rows along the main scanning direction, and each of the rows includes five openings 3*a*. The four actuator units 21 each having a trapezoidal shape in a plan view are arranged in two rows in a zigzag pattern along the main scanning direction. The zigzag pattern of the four actuator units 21 is inverse to the zigzag pattern of the openings 3*a*. The actuator units 21 are spaced from each other with respect to the sub scanning direction, and oblique sides of every neighboring actuator units 21 overlap each other with respect to the main scanning direction.

Manifold channels 5 which communicate with the respective openings 3*a* are formed within the passage unit 4. Each manifold channel 5 branches into a plurality of sub manifold channels 5*a* which extend in the main scanning direction. As shown in FIG. 7, four sub manifold channels 5*a* extend in a region opposed to each actuator unit 21. A plurality of individual ink passages 7 each extending through an aperture 12 which functions as a throttle and a pressure chamber 10 to a nozzle 8 (see FIG. 9) are connected to each sub manifold channel 5*a*.

The individual ink passage 7, which is formed for each nozzle 8, extends upward from the sub manifold channel 5*a*, spreads horizontally in the aperture 12, further extends upward, spreads horizontally again in the pressure chamber 10, then extends obliquely downward away from the aperture 12, and extends vertically downward to the nozzle 8. In this way, an ink passage extending from the opening 3*a* to the nozzle 8 is formed in the passage unit 4.

Ink reserved in the reservoir unit 90 is supplied through the respective openings 3*a* to the manifold channels 5 and the sub manifold channels 5*a*. Further, the ink is distributed from the sub manifold channels 5*a* to the respective individual ink passages 7, and ejected from the nozzles B.

On a lower face of the passage unit 4, a plurality of small-diameter nozzles 8 are arranged in a matrix in a region corresponding to a region where each actuator unit 21 is bonded (see FIG. 8). On the upper face of the passage unit 41 pressure chambers 10 for the respective nozzles 8 are arranged in a matrix in a region corresponding to the region where each actuator unit 21 is bonded. In a plan view, the pressure chamber 10 has a substantially rhombic shape. As shown in FIG. 8, the pressure chambers 10 are arranged in rows at regular intervals along a lengthwise direction of the passage unit 4. In a region where one actuator unit 21 is bonded, a total of sixteen rows of pressure chambers 10 are arranged in parallel with each other. The nozzles 8 are arranged in the same manner as the pressure chambers 10 are.

On an upper face of the actuator unit 21, individual electrodes 35 are formed at positions corresponding to the respective pressure chambers 10 (see FIG. 8). The individual electrode 35 is slightly smaller than the pressure chamber 10. A not-shown flexible printed circuit board is connected to each actuator unit 21. Based on a drive signal transmitted through the flexible printed circuit board, a voltage between each individual electrode 35 and a not-shown common electrode which is formed over an entire region of the actuator unit 21 is controlled. By such controlling, a portion of the actuator unit 21 where an individual electrode 35 is formed is deformed to apply ejection energy to ink contained in a corresponding pressure chamber 10, so that the ink in the pressure chamber 10 is ejected from a corresponding nozzle 8.

As shown in FIG. 9, the passage unit 4 is formed by a total of nine plates made of a metal such as SUS430 being put in layers and bond-fixed to one another. The nine plates are a cavity plate 22, a base plate 23, an aperture plate 24, a supply plate 25, three manifold plates 26 to 28, a cover plate 29, and a nozzle plate 90.

In the above-described ink-jet: head 1, ink having flown from the ink inflow hole 71 into the first space 74 passes upward through the filter 73 and flows into the second space 75. An impurity in the ink is captured by the filter 79 and, when inkflow stops, drops down on the surface of the damper film 78. Since the surface 78*a* of the damper film 78 facing the ink passage 73 has a portion inclined relative to the horizon, an impurity having dropped on the inclined portion moves downward, that is, toward the upstream with respect to the inkflow, along the surface 78*a*. In this manner, a plurality of impurities are collected. The plurality of impurities thus collected make an impurity block. The impurity block has greater mass than that of one small impurity. Therefore, even though ink in the ink passage 73 starts flowing again toward the filter 79, the impurity block hardly moves toward the filter 79. Even if the impurity block is carried together with the ink toward the filter 79, the impurity block which is sufficiently larger than a mesh of the filter 79 is hardly captured by the filter 79. In addition, since the impurity block once formed is hard to disassemble, it hardly occurs that an impurity derived from the impurity block is captured by the filter 79. Therefore, the filter 79 is not easily clogged, and undersupply of ink which may be caused by impurities is suppressed.

Since the nonopposing region of the damper film 78 is located lower than the opposing region thereof, an impurity having dropped on the surface 78*a* of the damper film 78 goes away from the filter 79. Therefore, an impurity captured by the filter 79 hardly clogs the filter 79 again.

Since the damper film 78 is inclined at a constant angle relative to the horizon, an impurity having dropped on the surface 78*a* of the damper film 78 is carried to a position which is relatively distant from the filter 79. This can more effectively prevent the filter 79 from being clogged again.

Since the damper film 78 having flexibility is used as a sealing member, an impurity existing on the surface 78*a* of the damper film 78 can be effectively moved in the inclination direction along with vibration of the damper film 78.

Next, a modification of the above-described embodiment will be described below. The same members as in the above-described embodiment will be denoted by the same reference numerals, without specific descriptions thereof.

Figure 10A:
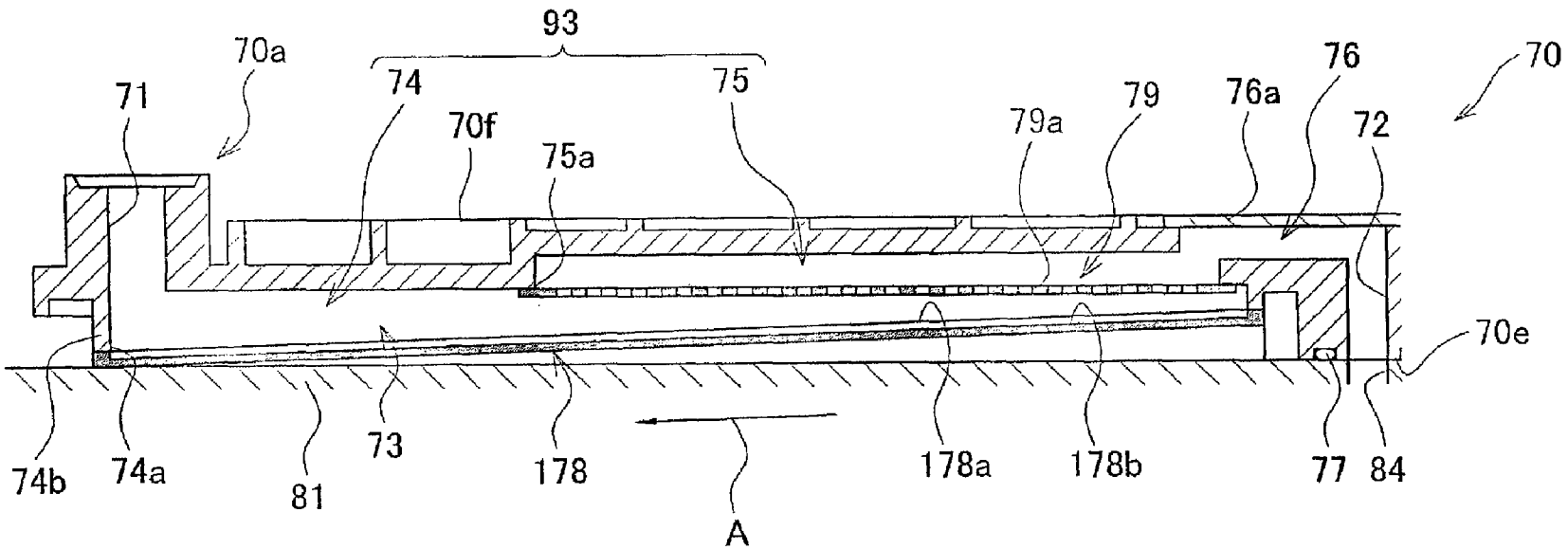
FIG. 10A is a sectional view of a filter support which is included in an ink-jet head according to a modification.
Figure 10B:
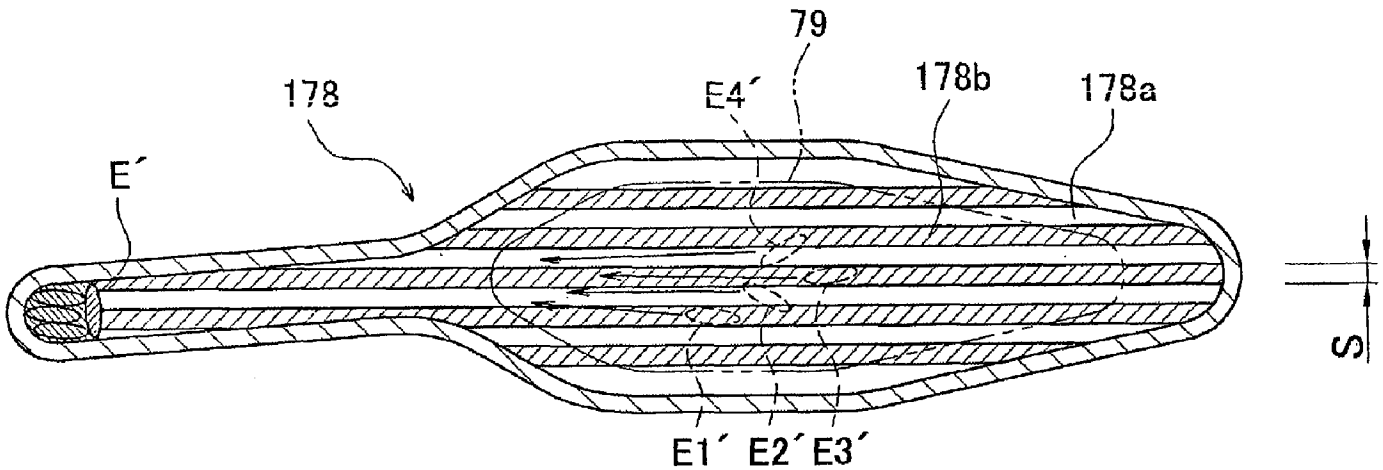
FIG. 10B is a schematic plan view of a damper film illustrated in FIG. 10A.

In this modification, a damper film 178 is the same as the above-described damper film 78 except that grooves 178*b* formed on a surface 178*a* of the damper film 178 facing the ink passage 73 differ from the grooves 78*b* of the damper film 78, as shown in FIGS. 10A and 10B. That is, the damper film 178 is the same as the damper film 78 in terms of a planar shape and being fixed so as to close the opening 74*a* of the first space 74. In addition, like the damper film 78, the damper film 178 is formed of a flexible resin film, too.

On the surface 178*a* of the damper film 178, a plurality of grooves 178*b* which open toward the ink passage 73 are formed by laser-beam machining. The grooves 178*b* extend in the ink flowing direction in the first space 74 or in the inclination direction A of the damper film 178. In FIG. 10B, the grooves 178*b* are hatched. In FIG. 10B, in addition, a peripheral portion of the damper film 178 which is fixed to the distal end of the outer side wall 74*b* of the first space 74 is also hatched. In this modification, a width S of an opening of the groove 178*b* is, like the width T of the opening of the groove 78*b*, formed to 1.2 times the diameter of the through hole 79*a* which is formed in the filter 79.

Here, a description will be given to movement of an impurity having dropped on the damper film 178. As described above, ink flowing through the ink inflow hole 71 into the first space 74 flows in the first space 74 substantially horizontally from left to right, and flows upward from the region opposed to the filter 79. The ink flows through the filter 79 into the second space 75. At this time, in accordance with ink vibration caused by ink introduced through the ink inflow hole 71, the damper film 178 displaces in a substantially vertical direction in a short cycle, to absorb the ink vibration. In a case where ink contains impurities, inlets of a plurality of through holes 79*a* are closed with a plurality of impurities. In this way, the impurities existing in ink which flow from the first space 74 to the second space 75 are captured by the filter 79.

When inkflow stops, impurities E1' to E4' captured by the filter 79 are, due to their own weight, separated from the filter 79 and drop into the grooves 178*b* and on the surface 178*a* in a region opposed to the filter 79 of the damper film 178, as illustrated with broken lines in FIG. 10B.

The damper film 178 is inclined at a constant angle relative to the horizon so that the nonopposing region is located lower than the opposing region. Accordingly, impurities having dropped on the surface 178*a* and in the grooves 178*b* slide down or roll down in the inclination direction A. At this time, although inkflow is stopping, the damper film 178 displaces in the vertical direction in a short cycle because of various impacts from the outside. Therefore, force making the impurities E1' to E4' fly toward an upper left (that is, toward a most upstream portion of the damper film 178) as described above acts on the impurities E1' to E4'. In this way, the impurities E1' to E4 which are illustrated with broken lines in FIG. 10B respectively move in directions arrowed in FIG. 10B (which are substantially the same as the inclination direction A), that is, move to the most upstream portion of the damper film 178. In the same manner as described above, the impurities E1 to E4' thus collected at the most upstream portion of the damper film 178 make an impurity block E', as shown in FIG. 10B. Therefore, the same effects as described above can be obtained.

Figure 11A:
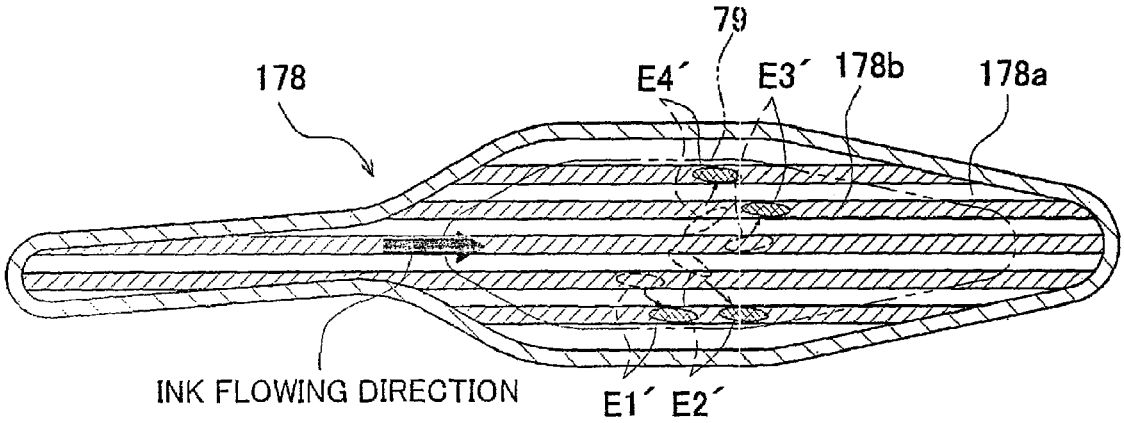
FIGS. 11A and 11B show that impurities existing on a surface of the damper film are moving.
Figure 11B:
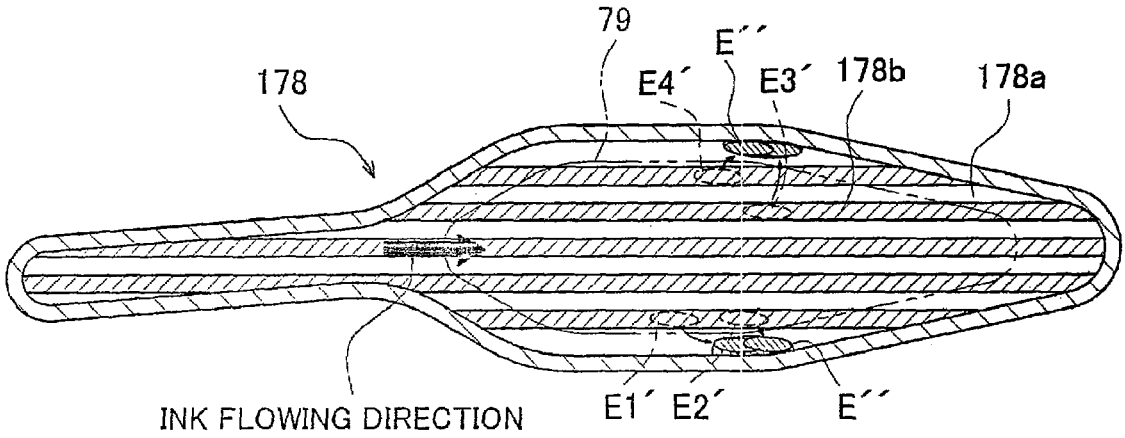

When ink starts flowing at a time before the impurities E1' to E4' reach the most upstream portion of the damper film 178 and at a time when the impurities E1' to E4' are dropping from the filter 79 onto the damper film 178, the impurities E1' to E4' illustrated with broken lines in FIG. 11A respectively move in directions arrowed in FIG. 11A, that is, move toward the downstream on the damper film 178. However, inkflow is fastest in a central portion of the damper film 178 which is distant from the outer side wall 74*b*. Therefore, the impurities E1' to E4 move toward the downstream and at the same time move toward the outer side wall 74*b*. As a whole, the impurities E1' to E4' move into any of the grooves 178*b*. At this time, due to ink vibration, the damper film 178 displaces in the vertical direction in a short cycle. Accordingly, the impurities E1' to E4' fly out of the grooves 178*b* and, due to inkflow toward the outer side wall 74*b*, move from their positions illustrated with broken lines in FIG. 11B to the grooves 178*b* closer to the outer side wall 74*b*, and further to a vicinity of the outer side wall 74*b*. Finally, all the impurities E1' to E4' reach the vicinity of the outer side wall 74*b* which is located outside a region opposed to the filter 79 of the damper film 178, and make an impurity block E". Thus, the same effects as described above can be obtained. In this modification as well, by forming the width S of the groove 178*b* to within a range from 0.8 to 1.2 times the diameter of the through hole 79*a*, the impurity can more effectively be moved in the inclination direction.

Figure 12A:
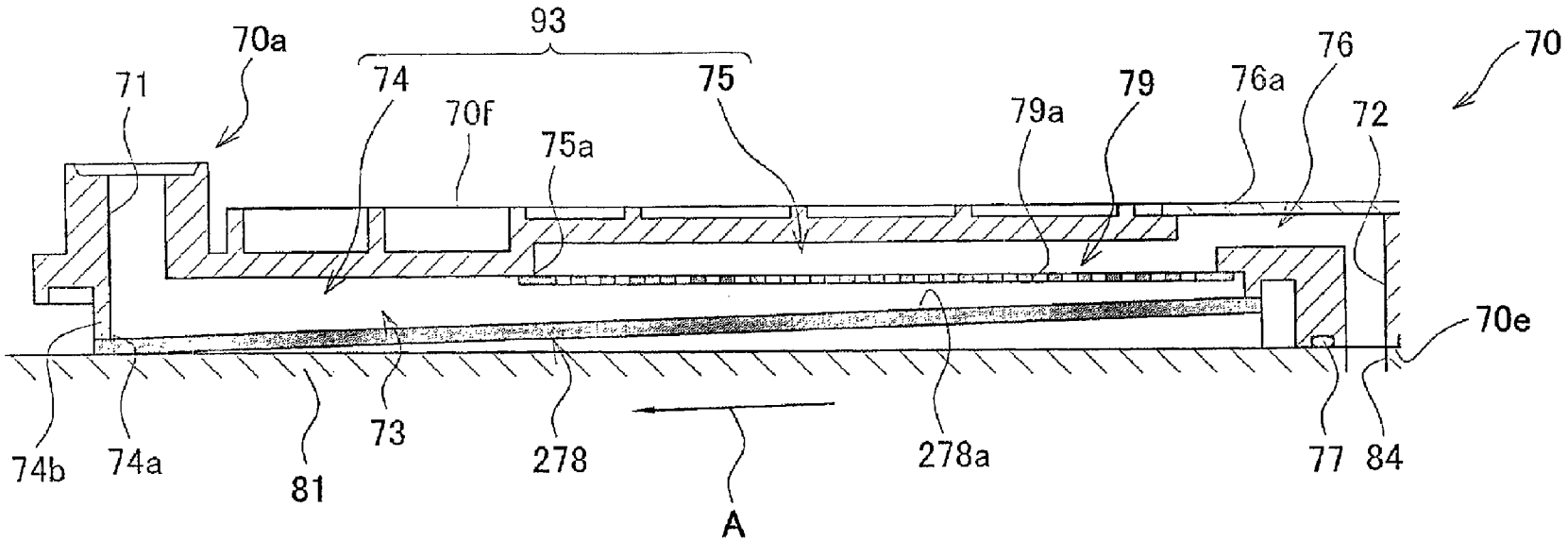
FIG. 12A is a sectional view of a filter support which is included in an ink-jet head according to another modification.
Figure 12B:
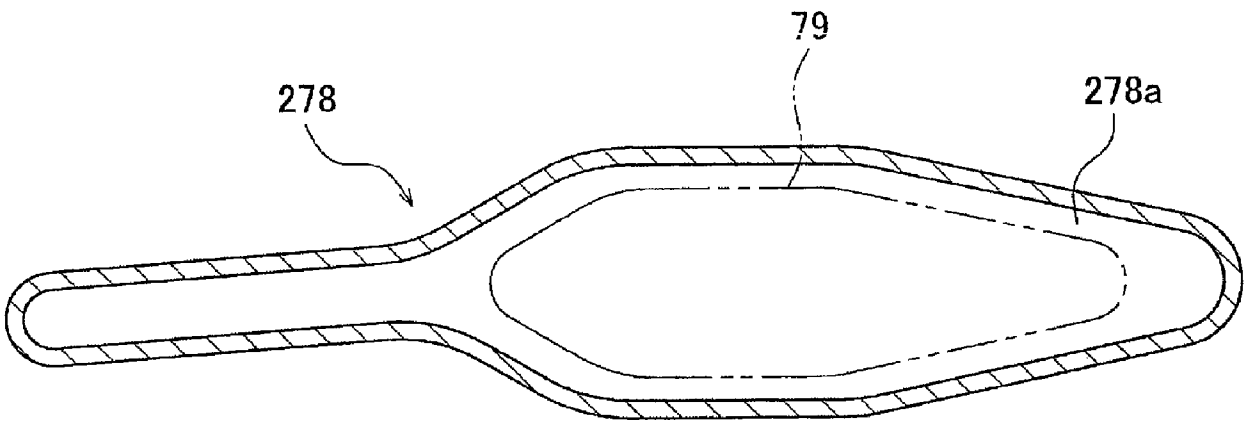
FIG. 12B is a schematic plan view of a damper film illustrated in FIG. 12A.

In another modification, like the above-described damper films 78 and 178, a damper film 278 is fixed to the filter support 70 so as to close the opening 74*a*, as shown in FIG. 12A. As shown in FIGS. 12A and 12B, the damper film 278 is the same as the above-described damper films 78 and 178 except that no groove is formed on its surface 278*a* facing the ink passage 73. According to this modification, the surface 278*a* of the damper film 278 facing the ink passage 73 is one inclined plane inclined relative to the horizon at an inclination angle which is constant anywhere in the surface 278*a*. Accordingly, like in the modification described above with reference to FIG. 10A, impurities having dropped on the surface 278*a* slide down or roll down in an inclination direction, to be collected at a most upstream portion of the damper film. The plurality of impurities thus collected form an impurity block, which is the same as described above. Therefore, the same effects as described above can be obtained.

In the embodiment and the two modifications described above, the damper films 78, 178, and 278 may not have flexibility, that is, may be a sealing member which does not displace in the vertical direction in accordance with ink vibration or various impacts from the outside. Such a sealing member may be made of any kind of material, but it is preferable that a material of the sealing member is of the same kind as a material of the filter support 70, because the sealing member is fixed to the filter support 70. The sealing member cannot displace in the vertical direction, but a surface of the sealing member facing the ink passage 73 forms an inclined plane. Therefore, impurities separated from the filter 79 and having dropped on the sealing member due to their own weight can be moved to a most upstream portion of the sealing member. Thus, the same effects as described above can be obtained.

In the above-described embodiment, the damper film 78 is, in a substantially entire region thereof, inclined at a constant angle relative to the horizon. However, the sealing member can move impurities and make an impurity block, as long as at least a part of an opposing region of the sealing member is inclined relative to the horizon. The sealing member may be inclined in such a manner that the opposing region is located lower than a nonopposing region. In such a case as well, impurities can be moved away from the filter 79. In addition, the grooves 78*b* and 178*b* provided in the damper film 78 and 178 may be formed not in an entire region of the surface 78*a* and 178*a*, but only in a region opposed to the filter 79. In such a case as well, the same effects as described above can be obtained.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a passage component which defines an ink passage including an ink inflow hole through which ink flows in, an ink outflow hole through which ink having flown in through the ink inflow hole flows out, and a middle hole having an opening which opens downward and formed between the ink inflow hole and the ink outflow hole, the ink passage extending from the ink inflow hole through the middle hole to the ink outflow hole;

a filter which is formed with a plurality of through holes for filtering ink, and which partitions the middle hole into a first space which communicates with the ink inflow hole and includes the opening and a second space which communicates with the ink outflow hole; and a sealing member which seals the opening, and has a first region which is opposed to the filter with respect to a vertical direction, wherein:

the filter is mounted to the passage component in such a manner that ink passing through the filter flows from the first space upward into the second space; and a surface of the first region of the sealing member facing the ink passage has a portion which is inclined relative to a horizon.

2. The ink-jet head according to claim 1, wherein:

the sealing member further has a second region which is not opposed to the filter with respect to the vertical direction and located upstream of the first region with respect to inkflow within the ink passage; and the surface is inclined in such a manner that the second region is located lower than the first region.

3. The ink-jet head according to claim 1, wherein the sealing member is inclined at a constant angle relative to the horizon.

4. The ink-jet head according to claim 1, wherein the sealing member is a flexible film.

5. The ink-jet head according to claim 1, wherein a plurality of grooves which open toward the ink passage and extend in a direction perpendicular to an inclination direction of the sealing member are formed in the surface of the first region.

6. The ink-jet head according to claim 5, wherein a width of the groove is within a range from 0.8 to 1.2 times a diameter of the through hole.

7. The ink-jet head according to claim 1, wherein a plurality of grooves which open toward the ink passage and extend in an inclination direction of the sealing member are formed in the surface of the first region.

8. The ink-jet head according to claim 7, wherein a width of the groove is within a range from 0.8 to 1.2 times a diameter of the through hole.

9. The ink-jet head according to claim 1, wherein the surface is one inclined plane inclined relative to the horizon at an inclination angle which is constant anywhere in the surface.

* * * * *